United States Patent [19]

Evasick

[11] Patent Number: 5,069,185

[45] **Date of Patent: * Dec. 3, 1991**

[54] DIESEL TUNE-UP METHOD

[75] Inventor: Robert J. Evasick, San Diego, Calif.

[73] Assignee: Edward J. Evasick, San Ysidro, Calif.

[ * ] Notice: The portion of the term of this patent subsequent to Oct. 24, 2006 has been disclaimed.

[21] Appl. No.: 538,568

[22] Filed: Jun. 15, 1990

[51] Int. Cl.[5] ..... F02M 7/00

[52] U.S. Cl. ..... 123/435

[58] Field of Search ..... 123/419, 435, 436, 479, 123/481

[56] References Cited

U.S. PATENT DOCUMENTS

| | | | |
|---|---|---|---|
| 4,475,511 | 10/1984 | Johnson et al. | 123/436 |
| 4,476,833 | 10/1984 | Johnson et al. | 123/436 |
| 4,875,451 | 10/1989 | Evasick et al. | 123/435 |
| 4,883,038 | 11/1989 | Nakaniwa | 123/436 |
| 4,930,479 | 6/1990 | Osawa et al. | 123/436 |
| 5,016,591 | 5/1991 | Nanyoshi et al. | 123/436 |

FOREIGN PATENT DOCUMENTS

| | | | |
|---|---|---|---|
| 0046352 | 3/1984 | Japan | 123/436 |
| 0038853 | 2/1987 | Japan | 123/419 |

*Primary Examiner*—E. Rollins Cross
*Assistant Examiner*—Robert E. Mates
*Attorney, Agent, or Firm*—Ralph S. Branscomb

[57] ABSTRACT

The electronic control module of the new generation of fuel injected internal combustion engines is adapted to compensate for variations in operating temperature or pressure readings among the cylinders, so that cylinders having a low temperature or pressure reading relative to the others will receive an increased flow of injected fuel, whereas cylinders running at a relatively high temperature and pressure compared to the other cylinders will receive a decreased fuel injection, so that the cooler cylinders run hotter and the hotter cylinders run cooler. The uniformity of power delivery among the cylinders, which is the object of the operating temperature and pressure adjustment, yields a more even delivery of power and a more efficient use of fuel.

10 Claims, 2 Drawing Sheets

DIESEL TUNE-UP METHOD

BACKGROUND OF THE INVENTION

The inventors of the instant invention are also the inventors of an invention entitled DIESEL TUNE UP METHOD, patented on Oct. 24, 1989, and having U.S. Pat. No. 4,875,451.

Both that patent and the instant disclosure deal with evening the power output among the cylinders of a fuel injected engine, particularly diesel engines. The prior invention dealt with the older style injection engines which were not electronically controlled. In those engines, the amount of fuel per injection stroke that each cylinder receives is dependent on the particular injector which operates with that cylinder. The above-referenced patent disclosed a method whereby high flowrate injectors are assigned to the lower compression cylinders to increase their compression and temperature, and low flowrate injectors were assigned to high temperature cylinders.

The leveling of the power delivery among the cylinders has produced dramatic improvements in fuel economy as demonstrated in extensive tests. Although not documented extensively, the engines also run more smoothly, and it is likely that by removing the jarring effect on the engine of uneven cylinder combustion, the life of the engine will be extended.

In the new generation of diesel engines and other fuel injected engines, the injectors are controlled by an electronic control module (ECM). The ECM timing of the injectors from a reference signal input from a magnetic trigger on the fly wheel. Ambient air pressure is also monitored and input to the ECM so that as the vehicle is driven up into the mountains, for example, the rate of fuel injection is decreased with the decrease in air pressure so that fuel does not remain unburned in the cylinders and be expelled through the exhaust as blue or black smoke. Applicants attorney has a diesel and can attest to this problem. At altitudes, he has been yelled at by other motorists, and on one occasion, in a ski area parking lot at about 9,000 feet, he was actually "stoned" with snowballs by complete strangers. The same vehicle operates virtually smoke-free at sea level.

The ECM also receives an input from the throttle (i.e. the accelerator petal) and factors this input into the injector settings. Thus, there is no direct mechanical or hydraulic control of the fuel flow rate at all. Anything that would effect the flow rate is input into the electronic control module, which then calculates the appropriate fuel flow-rate for the injectors, and signals the electronic distributor unit which includes drivers for the respective solenoids of the individual injectors.

The newer electronic controls no doubt result in improved engine performance and are hopefully reliable, as road repairs are generally impossible without replacement chips. Also, because the fuel delivered per injection is controlled by the ECM, it is no longer possible to effect the uniform power distribution among cylinders by physically allocating specific injectors to specific cylinders as was done according to the disclosure of the above-referenced patent.

SUMMARY OF THE INVENTION

The instant invention is an adaptation of the power evening techniques set forth in the prior patent which is suitable for use is electronically controlled injected engines. Rather than using individual injectors of different flow ratings, a thermodynamic value (either temperature or pressure) is monitored in each cylinder by a transducer, and the value of that cylinder is input into the electronic control module and factored into the fuel allocation for each individual cylinder so that uniform power output is achieved, or at least approximated.

There are basically two ways to achieve the uniform power output which is the goal of this invention. First, the average, or mean operating pressure or temperature of these cylinders can be calculated by the ECM, and then cylinders above or below this average by a certain margin will have their fuel allotments decreased or increased accordingly.

The second way of achieving uniformity is to input a standard thermodynamic value into the ECM, which ordinarily, would be in the form of writing the value in a table in the PROM of the ECM. This would be the ideal temperature or pressure at which the cylinders should all operate. This value would replace the mean or average value indicated above, with all cylinders being brought closer into conformity with the optimal operating value.

DETAILED DESCRIPTION OF THE PREFERRED EMBODIMENTS

Figure 1:
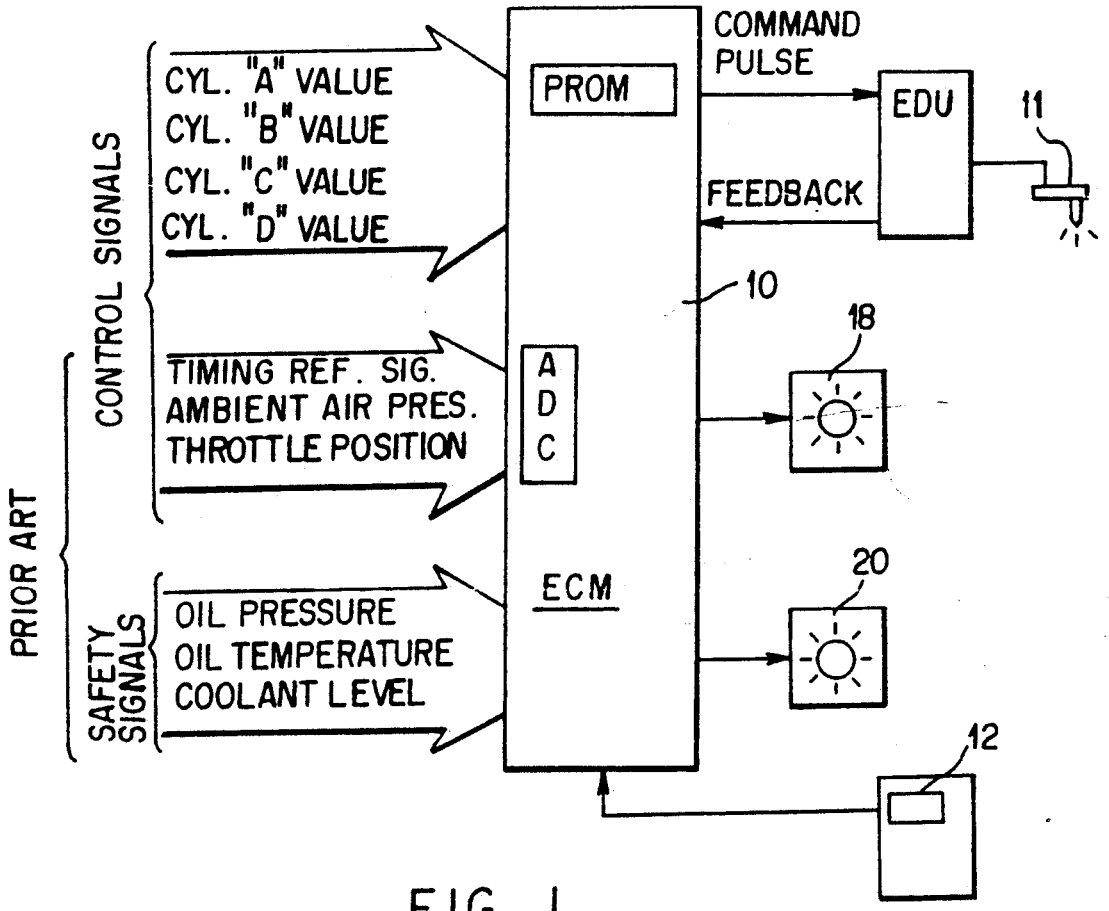
FIG. 1 is a diagrammatic illustration of the electronic control module (ECM), with its input signals and output controls.

FIG. 1 is a diagrammatic illustration of the electronic control module 10, with its inputs and outputs. This diagram is representative only, as other inputs and outputs could be incorporated at the behest of the designer. However, it does summarize the typical operating characteristics of an ECM.

In the illustrated embodiment, the ECM includes a PROM into which is written the control program. The ECM also contains a microprocessor and various and sundry other IC's, capacitors and resistors. The ECM is one example of a vast family of microcontrollers used in industrial processes, robotics, and virtually everything under the sun wherein specific changes of measurable values requires conversion into particular movements and actions of controlled equipment. The injector ECM is similar to, for example, an industrial candy making machine which controls and monitors the flow-rates of various ingredients into a mixer, controls the mixing rate, and then controls the heating temperature and duration and extrudes a final product. It is within a technology that has been largely developed over the last 20 years, but is very well developed at this time.

The way the ECM currently works is indicated by the input signals that are identified in FIG. 1. There are certain control signals that establish the timing and duration of the pulse of the injector 11, which is largely determined by the ambient air pressure and the throttle position. Control of the injectors is effected through an electronic distributor unit (EDU) which acts as a decoder and a driver for the injector solenoids. Other signals are not control signals, but are for safety, and specifically to prevent the engine from damaging itself if one of its sub-systems is operating in a failure mode. Unacceptable levels of oil pressure, oil temperature, and coolant levels reported to the ECM result in turning on warning lights either to stop the engine, or at least check it.

Figure 2:
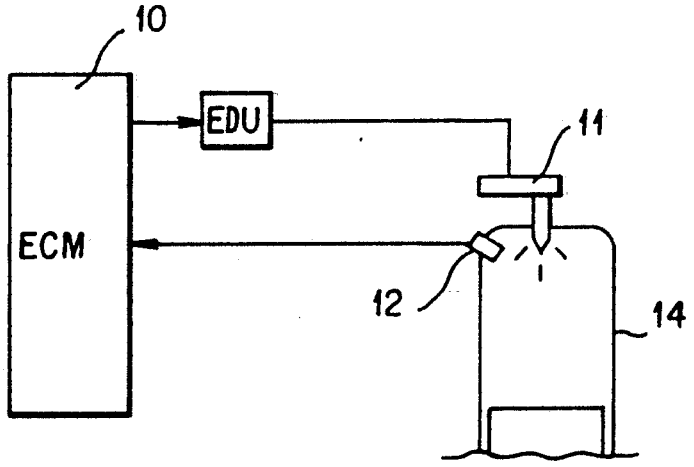
FIG. 2 is a diagrammatic illustration of a typical cylinder having a transducer monitoring its temperature or pressure value and its injector controlled by the ECM; and, FIG. 3 is a flow chart of a typical program which might be written in the PROM to implement the invention.

The instant invention requires a transducer 12 for each of the cylinders 14, as indicated in FIG. 2. The transducer would most often be a temperature sensor, as there are temperature sensors available which are durable and reliable when operating in adverse environments. However, this unit could also be a pressure transducer, inasmuch as pressure and temperature will have substantially parallel values over the operation of the engine. The term "thermodynamic value" is used herein, and in the claims, the cover both a temperature value, or a pressure value, as the two are substantially interchangeable insofar as the operation of the instant invention is concerned. The invention will be discussed in terms of temperature monitoring and regulation, but it will be understood that the pressure equivalent is inherent in the temperature discussions.

The transducer 12 communicates the thermodynamic value of the respective cylinder 14 to the ECM. The ECM must receive a thermodynamic value input from each of the cylinders, which are four in number in the illustrated embodiment, and are lettered from A through D. Typical vehicle diesel engines have 4, 6, or 8 cylinders. The transducer of course produces an analogue signal which must be translated into digital by an analogue-to-digital converter before it can be processed by the ECM. A separate analogue-to-digital converter (ADC) could be incorporated in the ECM for each cylinder, or a single ADC could be used and switched from one transducer to the next as each cylinder is polled, as will be described below when referencing the program flow chart.

Figure 3:
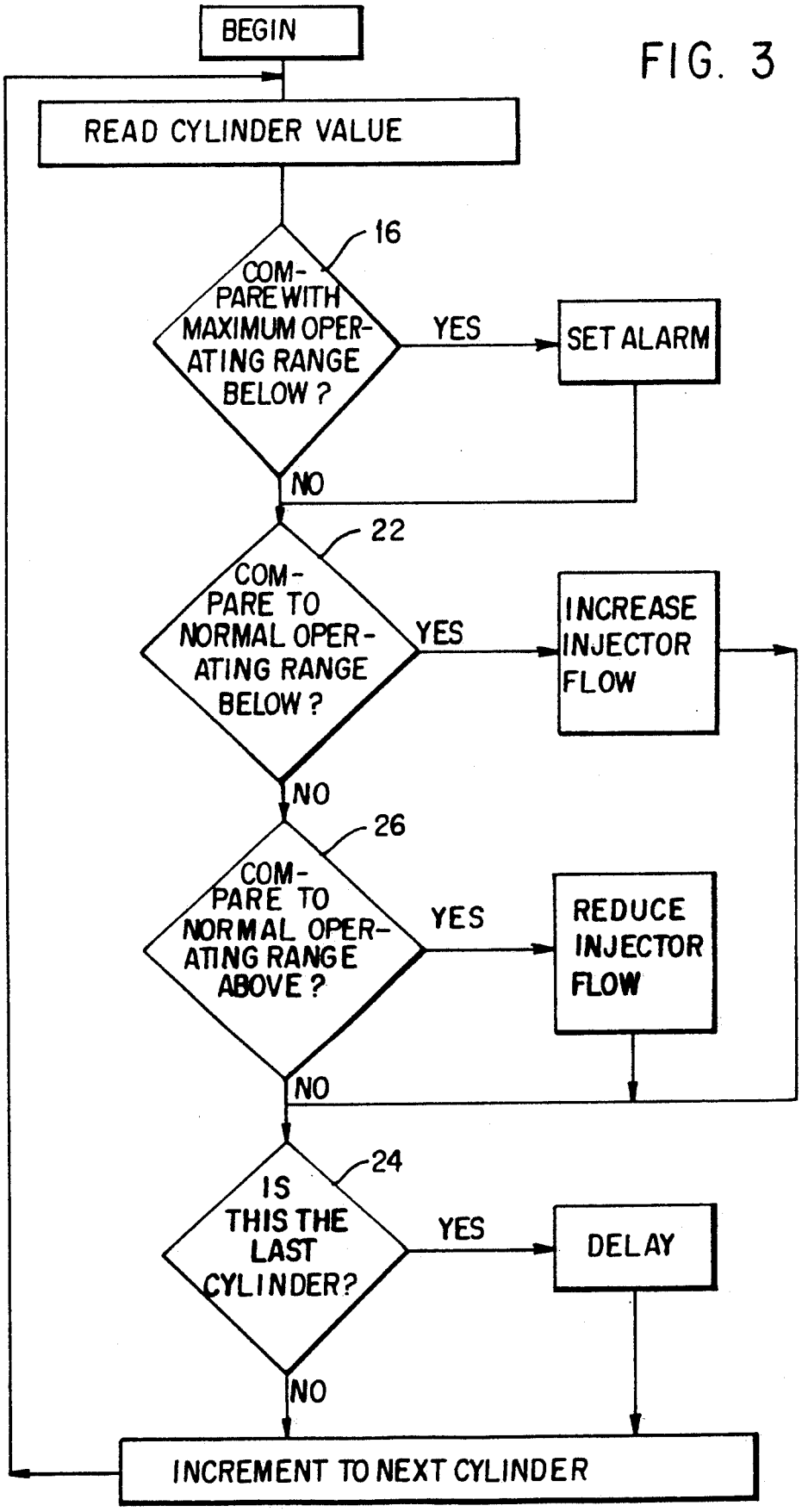

The flow chart of FIGS. 3 will now be referenced. This is an exemplary flow chart only, and does not by any means display the flow of all programs that would be capable of executing the instructions necessary to implement the invention.

Once the program begins, the ECM must read the cylinder temperature or pressure value from the first cylinder in the control sequence. Once the cylinder has been read, the value of the temperature or pressure is then compared with the maximum safe operating range of temperatures or pressures as indicated at 16 in FIG. 3. This data has been written to the PROM. For example, the range of acceptable temperatures might run from 1900 degrees F. to 2300 degrees F. The ECM includes high and low level comparators, and if the temperature falls outside of that range, an alarm is set. This could be either of the alarms 1 and 2 at 18 and 20, respectively in FIGS. 1, or a third alarm. Whatever alarm is used, it would signal that at least one cylinder is operating either too hot to be safe for the engine, or so cold that the cylinder is either non functional or is approaching the point at which it will not diesel anymore. Separate hot-cold alarms, or even cylinder-specific alarms could easily be used as well.

Although in the program indicated by the flow chart the system will continuously try to correct the out of line cylinder irrespective of whether or not the alarm is on, if the alarm is on and does not go off within a reasonable time, the operator is thus on notice to stop the engine or bring it in to a nearby service station.

If, as will usually be the case, the cylinder in question is not operating outside of the maximum safe range, the ECM then compares the thermodynamic value to a standard. The standard would be, for example, 2100 degrees F. This could be established as the optimum operating temperature of the engine, and be recorded in the PROM of the ECM. The PROM would also contain a record of the range within which the operating temperature would be considered normal, for example 20 degrees above or below the 2100 degrees F.

At the state 22 in the flow chart, a comparator determines whether the cylinder is operating below the acceptable range. If so, the injected fuel is increased by a predetermined amount.

The amount of increase of injected fuel for the cylinder in question would probably be the same no matter how far below the operating range the cylinder is functioning. Alternatively, the increase in fuel injection could be proportional to the deviation of the cylinder from the bottom of the operating range. Either way will result in bringing that cylinder up to the optimal level.

A simple increment would be the least complicated. Following the example set forth above, if the cylinder in question were operating 100 degrees F. below the bottom of the range, which would put it at 1980 degrees F., the ECM would increment the fuel injection by 1 cc, for example (that is, 1 cc over a thousand injector strokes, raising the injection does from, said, 55 cc to 56 cc). Although this increase might be inadequate to bring the cylinder up to the proper temperature, the program will automatically increment the injector dose again the next time it checks the cylinder until the temperature either falls within the acceptable range, or the maximum injection rate permissible by the system is reached.

In any event, after each injector dose increases loop, the program returns to the "last cylinder" decision diamond 24. If the checking sequence is cylinders A, B, C and D, and cylinder D had just been checked, the program would go into a delay mode. Although the delay would be optional, because the program can be executed in microseconds, a delay of a few seconds minimum should be incorporated after each readjustment of all the cylinders to permit the temperature and pressure to stabilize after the adjustment before the next sampling is made. Thereafter, the program is begun over, and is executed for each cylinder until the delay is reached again after the last cylinder has been checked and re-set if necessary.

To finish with the program diagramed in the flow chart of FIGS. 3, the above-normal diamond is indicated at 26. This operates the same way for cylinders above normal as diamond 22 operates for below normal cylinders.

As an alternative to using an optimal thermodynamic value as a standard, the standard could be calculated as the mean, or average, of the actual temperatures or pressures in the cylinders. The program to do this would be written to the PROM. A flow chart for this king of subroutine is not included, as it represents very basic programming. Appropriate engine starting and temperature stabilizing delays would be incorporated into the program to ensure reasonably characteristic value readings.

Although there is a wide range of possible programming approaches, FIG. 3 illustrates a typical program that would work. As described, the microprocessor is operating in a polling mode. At the end of each time delay, the transducer of each cylinder is sequentially polled until all have been polled, and the next delay period begins. Alternatively, the microprocessor could work in an interrupt mode in which it is tending, uninterrupted, to its other duties until one of the cylinders migrates outside of the acceptable operating range, at which point the microprocessor is interrupted and caused to execute the program of FIG. 3.

There have been no studies of the electronic system to determine whether a substantial savings in fuel or a reduction in engine wear have occurred. However, there is no reason to think that savings with electronic engines would not be just as much as with the prior invention applies to engines of previous design. As set forth in the issued patent which is referenced above, long studies covering thousands of miles of vehicle use have pointed to savings of on the order of 25% when an older engine has been tuned to even the power output of each of the cylinders. The instant invention should prove even greater in savings inasmuch as it more accurately brings all the cylinders in line. Because once the program has been written and incorporated into the ECM, it costs virtually nothing to replace it for future production, and does add nothing to the operating cost of the engine, it represents a case of getting something for (almost) nothing. The fuel savings should go on forever, and there would be no increase in collateral costs of operation of maintenance.

It is hereby claimed:

1. A method for improving the performance of a multi-cylindered internal combustion engine having fuel injection by injectors controlled by an electronic controller, with the cylinders having internal thermodynamic operating values, comprising the following steps:

(a) With electronic thermodynamic value transducers, sensing the operating values inside the individual cylinders of the engine;

(b) With the electronic controller connected to the transducers, comparing the various thermodynamic operating values within the various cylinders to a standard thermodynamic value; and (c) Controlling the injectors such that cylinders operating at least a minimum amount below said standard thermodynamic value receive more fuel, thus elevating the thermodynamic operating value in the respective cylinder, and cylinders operating at values at least a minimum amount above said standard thermodynamic value receive relatively less fuel, such that thermodynamic operating values in the individual cylinders of said engine tend toward said standard thermodynamic value.

2. A method according to claim 1 wherein said standard thermodynamic value comprises a pre-established optimal performance value.

3. A method according to claim 1 wherein said standard thermodynamic value comprises the average of the values of all of the cylinders.

4. A method according to claim 1 wherein said standard thermodynamic value comprises the mean value of all of the cylinders.

5. A method for improving the performance of a multi-cylindered internal combustion engine having fuel injection by injectors controlled by an electronic controller, with the cylinders having internal thermodynamic operating values, comprising the following steps:

(a) With electronic thermodynamic value transducers, sensing the operating values inside the individual cylinders of the engine;

(b) With the electronic controller connected to the transducers, comparing the various thermodynamic operating values within the various cylinders to a standard thermodynamic value;

(c) said controller establishes a range of values above and below said standard thermodynamic value, and if the value of any cylinder is within said range, the setting of the respective injector remains unchanged; and, (d) Controlling the injectors such that cylinders operating at least a minimum amount below said standard thermodynamic value receive more fuel, thus elevating the thermodynamic operating value in the respective cylinder, and cylinders operating at values at least a minimum amount above said standard thermodynamic value receive relatively less fuel, such that thermodynamic operating values in the individual cylinders of said engine tend toward said standard thermodynamic value.

6. A method according to claim 5 wherein said controller including an on-board microprocessor and is programmed to interrupt said microprocessor when any value of any of said cylinders falls outside of said 7. A method for improving the performance of a multi-cylindered internal combustion engine having fuel injection by injectors controlled by an electronic controller, with the cylinders having internal thermodynamic operating values, comprising the following steps:

(a) With electronic thermodynamic value transducers, sensing the operating values inside the individual cylinders of the engine;

(b) With the electronic controller connected to the transducers, comparing the various thermodynamic operating values within the various cylinders to a standard thermodynamic value;

(c) Controlling the injectors such that cylinders operating at least a minimum amount below said standard thermodynamic value receive more fuel, thus elevating the thermodynamic operating value in the respective cylinder, and cylinders operating at values at least a minimum amount above said standard thermodynamic value receive relatively less fuel, such that thermodynamic operating values in the individual cylinders of said engine tend toward said standard thermodynamic value; and, (d) said electronic controller having written within non-volatile memory a range of thermodynamic values outside of which any cylinder so operating represents a disfunction serious enough to alert the operator, and upon the operation of any cylinder outside of said range, said controller energizes an alarm signal.

8. In an internal combustion engine having fuel injectors, means for normalizing operating thermodynamic values of all of the cylinders comprising:

(a) a thermodynamic value transducer operatively connected to each cylinder for sensing the operating thermodynamic value within the cylinder;

(b) an electronic controller connected to said transducers to receive data therefrom, and also being connected to said injectors and having a standard thermodynamic value and an acceptable deviation range of thermodynamic values stored in non-volatile memory; and, (c) said controller having a program which compares the thermodynamic values of the individual sensors to said standard thermodynamic value and deviation range, and increases the amount of fuel injected into any cylinders operating below said range and decreases the amount of fuel injected into any cylinders operating above said range.

9. Structure according to claim 8 wherein said standard thermodynamic value is calculated by said electronic controller as the average of the thermodynamic values of the individual cylinders.

10. Structure according to claim 8 wherein said standard thermodynamic value is a pre-selected optimal operating value.

* * * * *